US009328594B2

(12) United States Patent
Linetskiy

(10) Patent No.: US 9,328,594 B2
(45) Date of Patent: May 3, 2016

(54) METHOD FOR DEVELOPING DEPOSITS AND EXTRACTING OIL AND GAS FROM FORMATIONS BY INJECTING CONDUCTIVE FLUID INTO FORMATION AND CREATING ELECTRIC ARC

(71) Applicant: Alexander Petrovich Linetskiy, St. Petersburg (RU)

(72) Inventor: Alexander Petrovich Linetskiy, St. Petersburg (RU)

( * ) Notice: Subject to any disclaimer, the term of this patent is extended or adjusted under 35 U.S.C. 154(b) by 0 days.

(21) Appl. No.: 14/348,402

(22) PCT Filed: Jul. 15, 2013

(86) PCT No.: PCT/RU2013/000605

§ 371 (c)(1),
(2) Date: Mar. 28, 2014

(87) PCT Pub. No.: WO2014/014390

PCT Pub. Date: Jan. 23, 2014

(65) Prior Publication Data

US 2014/0251599 A1 Sep. 11, 2014

(30) Foreign Application Priority Data

Jul. 17, 2012 (RU) ..... 2012130055

(51) Int. Cl.
*E21B 43/24* (2006.01)
*E21B 43/30* (2006.01)

(52) U.S. Cl.
CPC ..... *E21B 43/2401* (2013.01); *E21B 43/30* (2013.01)

(58) Field of Classification Search
CPC ..... E21B 43/2401; E21B 43/30; E21B 43/24
USPC ..... 166/248, 266, 252.1, 60
See application file for complete search history.

(56) References Cited

U.S. PATENT DOCUMENTS

| | | | | |
|---|---|---|---|---|
| 6,981,548 | B2 * | 1/2006 | Wellington et al. | 166/245 |
| 2008/0271885 | A1 * | 11/2008 | Kaminsky | 166/245 |
| 2011/0247819 | A1 * | 10/2011 | Nguyen et al. | 166/302 |

* cited by examiner

*Primary Examiner* — Doug Hutton, Jr.
*Assistant Examiner* — Silvana Runyan
(74) *Attorney, Agent, or Firm* — St Onge Steward Johnson and Reens LLC

(57) ABSTRACT

A method for developing deposits and extracting oil and gas from formations is provided including pumping electrically conductive fluid under pressure into a first heating well and a second heating well, creating an electrically conductive zone between the first heating well and the second heating well, positioning at least one first electrical current source into the first well and at least one second electrical current source into the second well such that the first and second electrical current sources come into contact with the electrically conductive fluid, applying alternating current to the at least one first electrical current source and the at least one second electrical current source, and generating an electric arc in the electrically conductive zone.

19 Claims, 1 Drawing Sheet

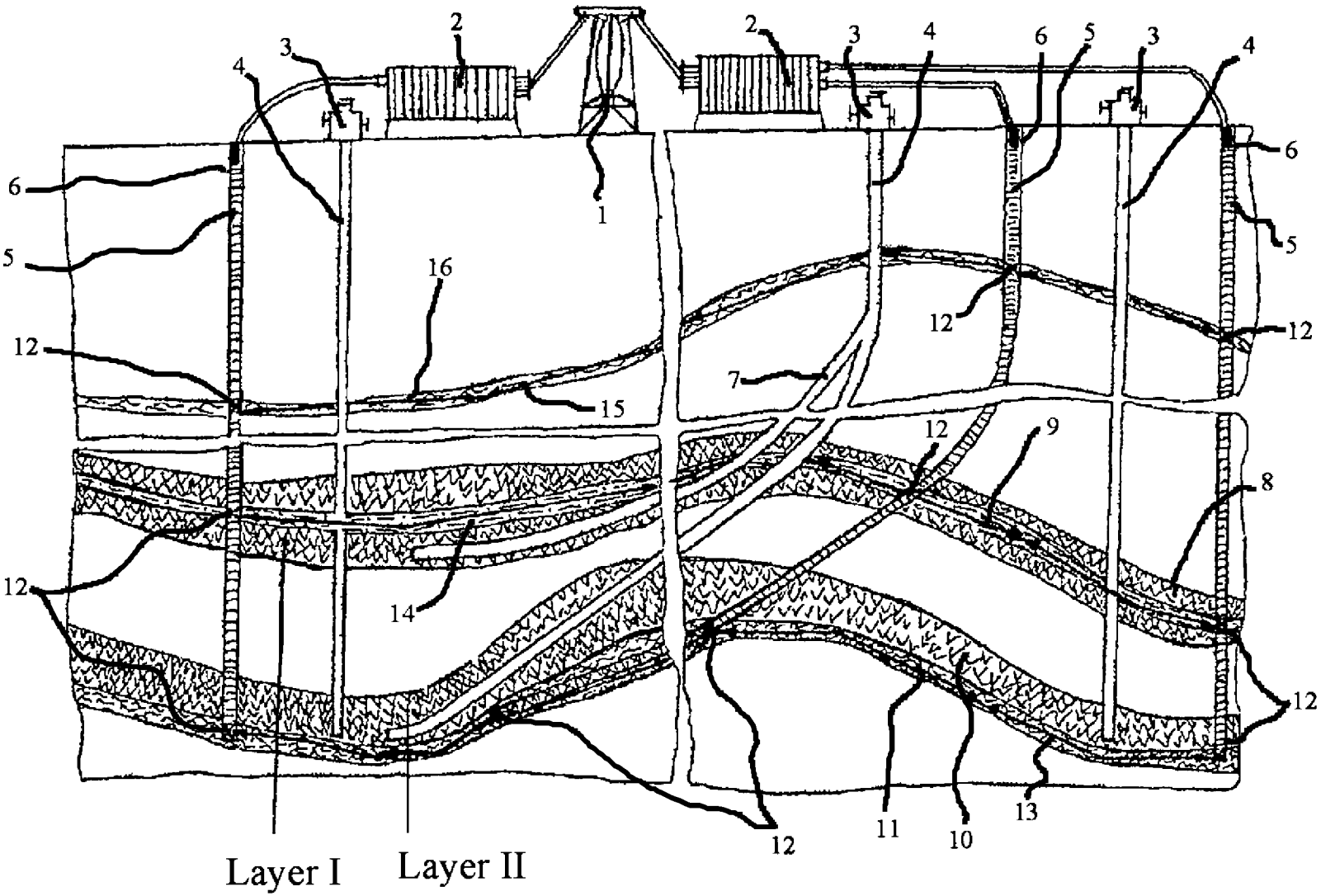
1
2
3
4
5
6
7
8
9
10
11
12
13
14
15
16
Layer I
Layer II

METHOD FOR DEVELOPING DEPOSITS AND EXTRACTING OIL AND GAS FROM FORMATIONS BY INJECTING CONDUCTIVE FLUID INTO FORMATION AND CREATING ELECTRIC ARC

FIELD OF THE INVENTION

The subject matter of the present invention generally relates to mining industry. In particular, the present invention relates to development of deposits and more efficient extraction of high-viscosity and other oils, bitumens, shale oils from kerogens, gas condensates, shale gases and gases from oil, gas and coal layers, and development of other mineral resources.

BACKGROUND OF THE INVENTION

A method is known that comprises layer hydraulic fracturing to improve productivity of wells and to increase its debit or intake capacity while watering the oil layers. Herein a single crack that is long enough is created within individual uniform layers to carry out a single or a multiple fracturing of the layer. At multi-layer accumulations, consisting of layers suit that has a weak hydrodynamic interconnection in between, an intervallic hydraulic fracturing of layers (directed hydraulic fracturing) is to be carried out. Operational liquid to be used for hydraulic fracturing of a layer is pumped into the layer via the tubing production string with a packer at the end to be further separated into the three kinds: the fracturing liquid, the sand carrier liquid, and the displacement fluid. (Suchkov B. M. Intensifying Oil Wells Output—Moscow—lzhevsk: Scientific Research Center "Regular and chaotic dynamics"; Computer research institute, 2007, pp. 396-410). Shutoff valves on well mouths and operational column are replaced with a special head for the hydraulic fracturing. As an operational liquid, there may be used technical layer water, salt and acid solutions (for carbonate basins), crude oil, etc. To decrease pressure losses (to 75%) high molecular weight polymers are added therein. To keep them open, the opened cracks besides the operational liquid are filled with some propping material, like glass sand, glass and metal balls and other mechanical materials sized 0.5 -1.5 mm. With the intervallic hydraulic fracturing at each particular layer of a suit comprising many layers those operations are carried out in conjunction with the processed interval isolation via the packer, sand and clay plug and special high-density liquids. The operational liquid pumping pressure exceeds ground pressure and overcomes strength properties of the layer processed.

The following describes main disadvantages of such a method of a force impact upon layers. High expenses in materials and power, and substantial time to be consumed, are needed to prepare the work that includes dismounting of the production well permanent equipment to install the replacing equipment to carry out the hydraulic fracturing. The industrial implementation must be preceded by technical and economic feasibility study for the method. Upon hydraulic fracturing completion, wells are to be deployed and shaken via regular methods for treating near-mine zones, thus requiring additional expenses and time to be consumed. A hydraulic fracturing crack relatively quickly is compressed by the ground pressure, despite the propping material therein. It is impossible to determine the crack fracturing formation direction together with its spatial location configuration within a layer, thus resulting in unexpected water and gas breaking into the wells. This method is quite sophisticated and it does not allow simultaneous treatment of even smaller area fields, as well as an entire field, thus remaining suitable only for individual wells.

A method is also known for electro-dynamic cleaning of a near-well zone off contaminants (Suchkov B. M. Intensifying Oil Wells Output—Moscow—lzhevsk: Scientific Research Center "Regular and chaotic dynamics," Computer research institute, 2007, pp. 282-283), based upon simultaneous impact upon the near-well layer zone via raised depression and high-intensity direct-current electric field. At the contaminated near-well zone, it results in hydraulic fracturing of capillary sheaths within fine-pored slice due to electro-osmotic effect, thus resulting in appearance of electrochemical, electro-kinetic, thermal and other factors within the capillary environment. Depending on the sign of an electric charge at the well electrode, an acid or an alkaline environment is to be formed, the temperature would rise for 10-20degrees Celsius, superficial inter-phase tension is decreased, volume flow rate for fluid displacement towards the well would increase. This provides for the oil industrial income to be initiated from the production layer via influencing it simultaneously with decreasing pressure and the direct current electric field with varying polarity. The electrode is first is charged with negative charge to call for the clay mud infiltrate from the near-well zone. Later on, when hydrocarbons appear, their income is intensified via substituting the electrode charge sign with a positive one.

The disadvantages of this method include limited scope of use, lower efficiency, higher implementation cost and lower maintainability.

A method is further known for developing and increasing oil, gas and other mineral resources rate of extraction from the earth interior (RU 2102587) that is designated as a prototype. According to the prototype, wells are sealed with packers on the layer cap level and solid electrodes are preliminarily placed therein, with high-voltage alternating current put therethrough to initiate an electric arc while melting a fuse link between pairs of solid electrodes or electrodes contacts separation, or by discharging through the intervals between solid electrodes of two neighbor wells under electrical voltage increased therein. An electric arc is to strike through the most conductive slice within the layer that has sufficient natural electric conductance, arising during oil and gas field formation, between solid electrodes of two neighbor wells by preheating natural conductive slice of layer with subsequent discharge of intervals through the same layer slice. Then, in order to move electric arcs within in-situ space in necessary order and sequence, the striking voltages are applied to electrodes of new neighbor wells at the field and those wells where arcs had already burned are de-energized.

The method has a number of disadvantages. First, is low reliability of discharge and initiating the electric arc under the most conductive natural slice to be found within the layer, as its conductivity may change on different sites of the field due to rock property change therein as well as their permeability and fracturing, as well as due to composition change in layer waters, gases, oils and other factors that affect the conductivity. Another disadvantage is providing reliable contacts with natural conductive slices of layers while using solid electrodes with small areas of contacts with conductive slices in layers, may be complicated. Yet another disadvantage is high cost of method implementation due to necessity of substantial power consumption and creating high voltages to heat and discharge natural conductive slices in oil and gas layers and initiating electric arcs between neighbor wells resulting from non-uniformity and non-constancy of natural conductive slices conductivity and small area of solid electrodes contacts with them.

SUMMARY OF THE INVENTION

Technical result of the invention is the most complete and effective extraction from oil and gas, coal, shale layers under most common conditions of all types of oils, bitumens, shale oils from kerogens, gas condensates, and gases via artificial creating within layers, rocks, and other geological formations of mineral resources at the fields of slices, zones and areas with raised electrical conductivity and initiating electric arcs therein to treat mineral resource fields.

Using the technology that is proposed by the invention results in substantial profit resulting from most complete extraction of oils and gases out of layers, to substantially improve ecology at territories comprising the fields, preventing oil spills from old wells remaining after developing fields with incompletely extracted resources from under the ground, to prevent blow-out of methane and other gases contained in oils into the atmosphere, that cause greenhouse effect. This method also allows destroying subsurface disposals waste and mortuaries with harmful radioactive and chemical substances via burning and evaporating it under the ground within electric arcs plasma without oxygen access, and also provides for melting into subsurface workings from ore bodies, veins, lens of metals, i.e. such as copper, nickel, aluminum, silver, gold and many other with very high electrical conductivity. Due to intensive extraction of oil, gas and other mineral resources time to develop the field would be reduced to obtain additional profit and without ecological harm for neighbor territories around the field.

Technical result of the invention is achieved by implementation of the method to develop fields for the most complete extraction of high-viscosity and shale oils, bitumens, gas condensates, shale gases and gases from oil, gas and coal layers, according to which pumping of various the operational liquids is carried out through wells, drilled at the fields, under various pumping pressures into layers, to place solid electrodes into them, with alternating current applied, electric arcs are initiated either between the solid electrodes of the two neighbor wells when oil and gas layers comprise natural electric conductive slices or between the pairs of solid electrodes within one well during separation thereof, or during melting the fuse link between them, move electric arcs within natural electric conductive slices within in-situ space between several neighbor wells of fields in necessary order and sequence, according to the invention, an operational liquid to be pumped under maximum pressures for particular conditions is electroconducting liquid with low viscosity, high electrical conductivity and density, are artificially created slices, zones and areas with raised electrical conductivity after pumping in individual oil and gas, coal and shale layers, and with suit of multiple layers either electrical conductivity of those slices is improved, or electrical conductivity of water-bearing slices or water-bearing horizons accompanying layers and located at their foot is raised, located next to layers in a suit and electroconducting liquid pumped therein from neighbor heating wells towards each other under maximum pressures for its penetration to maximum depth under particular conditions, liquid electrodes are connected in circuit of alternating-current sources of high-voltage from electroconducting liquid within heating wells and super capacitors on the surface to accumulate and fast discharge of substantial electromagnetic energy as high-power impulses of alternating current to artificially created conductive slices, zones and areas in layers and rocks, to further increase the voltage at liquid electrodes out of electroconducting liquid within heating wells, to carry out heating to get included micro-emulsions, chemical components and interacting therewith highly conductive materials micro-particles.

At new fields all newly drilled wells cased with mass-produced insolating glass-reinforced plastic pipes that are as durable as metallic ones, but have multiple advantages necessary to implement the method-such glass-reinforced plastic pipes are more flexible and have better thrust capacity, to withstand hydraulic impacts and pressure, to be efficient during electromagnetic well logging, they are not vulnerable to corrosion, resistant to aggressive environments, have more reliable pipe junctions, connection threads can be used many times, high temperature resistance, with absence of paraffin deposits of oils due to improved inner surface quality and properties of glass-reinforced plastic (its heat conductivity is 120 times less than the same for a metal). Pumping and compression pipes and other well equipment, except pumps, are also produced of glass-reinforced plastic that is a reliable insulator for equipment of wells to protect people working at the surface from electric current hazard and also to prevent leakages, influences and other risks. At fields in operation, where the metal casing pipes and well equipment were installed earlier and have high electrical conductivity, the equipment at the surface and workers are protected against electric current and high voltage hazard via additional installation of special insolating collars at casing pipes, pumping and compression pipes, in wells and in other appropriate locations at well mouths, that are also mass-produced by industry in various sizes to reliably insulate equipment used at the surface and to protect service workers from electricity hazard. At new and at long-in-operation fields, the heating well walls are not fixed with casing pipes throughout the entire layer thickness independent of durability characteristics of rocks, coal and shale, or other mineral resources to provide the most reliable contacts with liquid electrodes of electroconducting liquid and to improve its infiltration into the artificially created, after its pumping into layers and mountain rock array, slices, zones and areas with raised electrical conductivity. Should there, within weak and unstable oil and gas layers or coal and shale layers, well walls be partly damaged with the diameters being reduced, influenced by ground pressure, it does not affect the reliability of liquid electrodes contacts with artificially created, within layers and within mountain rock arrays, slices, zones and areas with raised electrical conductivity, after pumping the electrical conductivity liquid therein. In case of a long operation of heating wells, with multiple treatments their in-layer spaces via electric arc plasma, as necessary, the wells are repeatedly re-drilled to increase their diameters at unfixed throughout the entire layer thickness sites, step by step at a specified value via specialized hole openers to improve filtration into layers of the electroconducting liquid, upon completion the full cycle of layers treatment, rotation of heating wells is to be carried out to be used as production ones, to subsequent production of oil and gas from the same wells with the increased diameter after re-drilling and with improved filtration, and also increased oil and gas inflow resulting from substantial increase of their diameters (increased inflow cross-section) and due to the fact that the well walls, with increased diameters, are cleaned off mud cake resulting from drilling mud that penetrated during the initial wells drilling, while cracks and pores of the near-mine zone of layers, adjacent to wells, are cleaned off the sealing asphalt-resin-paraffin sediments, that remain therein during oils outflow into wells.

Wells diameters increasing operations while re-drilling via specialized hole openers restore natural filtration and layers permeability. Specialized hole openers are mass-produced and have different designs either to mechanically destroy the mountain rock, or may be built to order as combined type, when the mountain rocks are destroyed by high temperature impact via electric arc that is initiated at the specialized opener tip that destroys the rock, during contacts separation, in conjunction with mechanical rotation impacting the rocks that are already destroyed by high temperature, to provide the wells re-drilled with necessary diameters and ultimate shape. The design of such specialized openers allows moving it compact through the wells, like umbrellas, to gradually open it, as necessary, at the rocks and layers sites re-drilled. This operation takes place after determined time intervals and, as necessary, after sufficient squeezing of wells by mountain pressure resulting in substantial decreasing diameters and filtration degradation both for electroconducting liquid into layers, and oil and gas thereof into wells upon completion the full cycle of treatments and rotation of heating wells to be used as production ones. Resulting from such rotation of heating wells, and especially at final stages of fields developments new macro-systems that drain and filter oil and gas are formed, to allow extracting the entire movable oil and gas, including those from the beyond perimeter spaces of oil reservoirs that are considered non-extractable, and even from nonreservoir rocks with very low permeability in case of cross-flow and large contact areas of layers reservoirs with good permeability therewith, when preliminarily treated with electric arc plasma and with large diameters of wells drilled therethrough, especially inclined and horizontal ones, making it the most efficient during development of suits of many layers with differing thickness and with sophisticated geological formation conditions: float-overs, dropdowns, layers continuity breaks and other difficulties. All this results in a more efficient usage of earth interior to extract oil and gas out of fields to the maximum extend.

While drilling the geological survey wells at fields, a mandatory electromagnetic well-logging is carried out throughout the entire geological section of the mountain rock array to determine the thickness of the layers entered, various slices of rocks, water-bearing slices and horizons, suits of multiple layers, their separation distance from each other, and to reveal the slices within rocks and layers that have differing electrical resistance to determine, within the mountain rock, the slices with the least specific electric resistance, that means in other words having the best natural electrical conductivity, and it is within this subset one can select the most suitable slices to be used to implement the method proposed, via artificial raising their electrical conductivity even further, after pumping them with the electroconducting liquid under the maximum pressures suitable for particular field conditions towards maximum depth possible, between the neighbor heating wells. Usually the best electrical conductivity is possessed by water-saturated slices, consisting of different rocks within layers with good permeability and porosity, the water-bearing slices with underground waters containing large amount of the salts dissolved therein with different concentrations, and, in most cases, located at the foot of the layers and other mineral resources, as well as water-bearing horizons that are located near the layers, or the suits of multiple layers, as well as other geological formations within the mountain rock arrays, such as ores rich in metals.

In rare cases of very low permeability and porosity of mountain rocks and layers, as well as if water-bearing slices or horizons are absent nearby, as well as other slices with properties suitable to implement the method proposed, then between the two neighbor heating wells at sites not fixed with casing pipes and through the layers, towards each other, long drill holes are drilled having small diameters, i.e. 20-40 mm or more, to the distance of 30-80 m or more, via dedicated direct drilling devices with flexible glass-reinforced plastic pipes. Batches of several long drill holes that are drilled from neighbor heating wells towards each other, can cross and disperse with their bottoms within layers space from dozens of centimeters to some meters. During pumping therein the operational electroconducting liquid under maximum pressure, that is suitable for the conditions, from neighbor heating wells towards each other, the separating walls between the drilled holes would be destroyed to form a single electroconducting slice with small thickness to be filled with the electroconducting liquid and suitable to her and discharge such layers and rocks and to initiate electric arcs therein for their further treatment.

When a field contains oil and gas, coal or shale layers with substantial thickness, the operational electroconducting liquid is pumped into several slices, that are most suitable to treat such layers, and that are located at different distances, and the in-layer treatment with electric arcs is carried out stage-wise, either downwards throughout the layers thickness or, oppositely, upwards, depending on particular conditions of their location. When the field contains suits of multiple layers, either electrical conductivity if each layer within the suit is to be increased to be further treated with electric arc plasma, or a single layer is selected to be adjacent to several other layers or in between within the suits, or located either higher or lower thereof, and repeated treatment with electric arc plasma is carried out for the layer selected to improve oil and gas production efficiency, also from neighbor layers, resulting from the interference. After the abovementioned treatment procedure, the stressed-deformed state within closely located higher or lower neighbor layers is changed, and the ground pressure thereon by upper mountain rock thickness is lowered due to formation, via high temperature influence upon the layer within the suit treated, of large in size caves, oil and gas cross-flow channels as well as additional cracks systems at layer sites treated with electric arc plasma, during the evaporation of the substance that makes the rocks, coals, shales, oils, layer waters and other mountain rock components. After lowering the ground pressure to create substantial mountain rock array dislocation in between the closest neighbor layers within suits, permeability and crack and pores opening amount is increased within layers rocks, coals and shales, as well as other mineral resources. New crack systems and oil and gas cross-flow channels also result from dislocations within mountain rocks, as well as from high temperature influence upon layers. Herein oil and gas cross-flow takes place via these formed additional cracks and channels from the neighbor layers within suits, happened to be within treatment influence range of only one layer in between, at production wells at neighbor layers that are not treated yet with electric arc plasma, that are located within suits lower and higher from the close layer already treated. The same effect would take place should there, instead of one layer within a suit, a water-bearing slice or a water-bearing horizon with artificially raised electrical conductivity be treated-with electric arc plasma, after pumping them under pressure with electroconducting liquid, located close to layers or between them within suits of multiple layers, or located adjacent, either higher or lower, to individual layers with different thickness within mountain rocks. The abovementioned operations significantly reduce development time for all layers within suits at fields thus significantly reducing power consumption resulting in valuable profit after developing the suits of multiple layers independently of geological conditions of their formation and tectonic location complications resulting therefrom.

Should there be a more reliable electric arc ignition between the liquid electrodes a neighbor heating wells, that form a single electric circuit after pumping the electroconducting liquid into layers and rocks, due to good contacts in between, voltage value and power consumption may be reduced for heating, discharge, and electric arc ignition within slices, zones and areas of artificially created within layers and rocks. To increase alternating current impulses power during the electric arc ignition, the high voltage alternating current circuit is connected to powerful supercapacitors at the surface (it is also possible to connect large impedance reactive coils together with super-capacitors] to accumulate and release fast substantial electromagnetic power as powerful alternating current impulses into artificially created electricity conducting slices, zones and areas within layers and rocks.

After electric arcs ignition at predetermined field sites, they are moved within the space of layers and mountain rock arrays containing mineral resources, in order and sequence as appropriate, and to proceed this way, the electric arcs ignition voltage is applied to the liquid electrodes of other neighbor heating wells at the fields, while cutting off the voltage between those heating wells, where electric arcs had already burnt, and the process can be repeated many times. Order and sequence of connecting the new wells to the electric arcs burning process within layers, rocks, ore bunches, ledges and lenses is determined considering steady treatment of either the entire area of mineral resources field or only the particular sites area, to achieve maximum effect resulting from treating the mountain rock arrays that contain mineral resources with electric arc plasma.

Electric arc plasma treatment time for rock, ore and in-layer spaces at different fields would differ depending on physical and mechanical properties thereof, as well as chemical compositions and types of the mineral resources within the mountain rock arrays, their stressed-deformed state, geological conditions for location and a number of other factors. For every particular situation such time is determined experimentally depending on necessary temperatures and pressures to achieve under particular conditions to maximize the effect and the extraction extend for mineral resources of the field. The experimental results make it possible to carry out mathematical and computer three-dimensional modeling to determine optimal location of heating and production wells as well as order and/or sequence for field development within the shortest time and with maximum efficiency and minimum expenses and costs.

BRIEF DESCRIPTION OF THE DRAWINGS

The subject matter is accompanied with a drawing, where FIG. 1 represents the scheme of implementation for the method to develop fields and providing for the most complete extraction of oils-especially high viscosity, shale from kerogens, bitumens, gas condensates, gases from oil and gas and coal layers, shales and other mineral resources.

DETAILED DESCRIPTION OF THE INVENTION

FIG. 1 depicts a mountain rock section that shows one exemplary possible scheme of location, within its suit mass, that has two thick layers comprising high viscosity oil, with gas dissolved therein, with the first layer I, located higher relatively the earth surface, and the second layer II, that is located lower relatively the earth surface. Suit layer thickness is changed from 20 to 65 meters, while the distance in between them within the suit varies from 5 meters to 10 meters. The upper portion 8 of the first layer I is the thickest, its thickness reaches 35 meters and it has a low permeability reservoir that contains high viscosity oil. Towards the suit, consisting of the two oil and gas layers, vertical and horizontal-inclined wells 5 are drilled from surface, that are filled with operational electroconducting liquid under pressure, with carbon contacts 6 located therein at the well mouths. The electroconducting liquid in wells 5 contacts at sites 12 of the wells (points of possible pumping of electroconducting liquid into the slice 9 in the first layer I and into the water bearing slice 11 at the second layer II, as well as into the water-bearing horizon 15) with slices having the best natural electricity conductivity in rocks and layers, as revealed during the electromagnetic well logging survey:

- with water-saturated rock slice 9 and satisfactory permeability and porosity, that is located approximately in a middle of the first oil and gas layer I;
- with water-bearing slice 11 located at the foot of the second oil and gas layer II;
- with water-bearing horizon 15 with thickness from 1 to 2 meters located above the suit of layers close to the first oil and gas layer I at the distance from 1.5 to 3 meters.

Under natural conditions of layers and rocks bedding, the specific electrical resistivity of reservoir rocks, that are included into both layers, such as sandstones and clay shales, is changed from 200 to 600 Ohm and more, water-bearing rock slice 9 may change from 40 to 70 and more, water-bearing slice 11 located at the foot of the second oil and gas layer II and water-bearing horizon 15 may be from 8 to 20 and more. Upon pumping it with electroconducting liquid, their specific electrical resistivities may be decreased by orders, and their electrical conductivity would significantly improve, thus simplifying their heating to a discharge and electric arcs ignition.

Between heating wells 5, at optimal distance therefrom, from surface, vertical and inclined-horizontal production wells 4 are drilled to the same oil and gas layers within the suit, the walls of which are cased with glass-reinforced plastic pipes, to reliable isolate well-control equipment and shutoff valves 3 at the well surface from influence by high voltage and electric current. Pumping and compression pipes and other well equipment, except pumps, are also produced of glass-reinforced plastic. Inclined horizontal production wells are drilled in a way, that their main holes are located at the thickest part 10 of the second oil and gas layer II, while lateral holes 7 of the same production wells are drilled towards the first oil and gas layer I of the suit that consists of the two thick layers with stratified poorly-permeable reservoirs and high-viscosity oils. Such disposition allows saving on drilling the wells to gain oil and gas simultaneously from two layers, thus improving the production efficiency via treating layers with electric arcs plasma to reduce the time needed for development.

Heating wells 5 at surface are connected to a source of high voltage alternating current 1, the circuit of which includes powerful super-capacitors to accumulate energy 2, coupled with large impedance inductive coils to accumulate electric energy at surface to release powerful impulses of high voltage alternating current to the artificially created electricity conducting slices within layers and rocks of the field to treat it (after heating and discharge) with burning electric arcs plasma. The super-capacitors are mass produced to be used under wide range of temperatures (from +70 to −50 degrees Celsius), and their resource significantly exceeds 10 million charge-discharge cycles, they are recharged fast to release energy fast. From super-capacitors 2 with inductivity coils, the powerful impulses of high voltage alternating current are delivered by wires to the carbon contacts 6 placed within electroconducting liquid, at the mouths of the heating wells 5 that are filled with the operational electroconducting liquid under high pressure. Arrows at the scheme show electric arcs 14 ignited within water-saturated rock slice 9 with good permeability and porosity, located at the first oil and gas layer I, after pumping electroconducting liquid therein to raise electricity conductivity of the slice, and also electric arcs 13 within the water-bearing slice 11, located at the foot of the second oil and gas layer II, and electric arcs 16, ignited within the water-bearing horizon 15, that is located at close distance from the first oil and gas layer I within the suit, after pumping it with electroconducting liquid at sites 12 (at pumping points) of heating wells 5 to improve its electricity conductivity. Pumping the electroconducting liquid into the water-bearing horizon 15 to improve its electricity conductivity and to create an artificial electrically conductive slice for heating, discharge and ignition electric arcs therein would be carried out only in a situation, when it turns out that such treatment with electric arcs of the inlayer space of the first oil and gas layer I via artificially created electrically conductive slice 9 with raised electricity conductivity resulting from the pumping of the electroconducting liquid therein, would be insufficient to completely extract oil and gas from the upper portion 8 of the substantially thick (changing up to 35 m) oil and gas layer I, to necessitate additional impact after treating, with electric arcs, the water-bearing horizon 15, to influence after the treatment this portion of the layer downwards, via closely located thereto water-bearing horizon 15 with good permeability and electrical conductivity.

To ignite electric arcs between neighbor heating wells 5 of the field, voltages are increased at liquid electrodes of electroconducting liquid within those wells to heat slices 9 and 11 within layers I and II, as well as water-bearing horizon 1.5, and after the preliminary heating and rising the temperature to the value suitable for a discharge at both layers by slices with artificially increased electricity conductivity after pumping it as well as water-bearing horizon 15 with electroconducting liquid, electric arcs are ignited between the neighbor heating wells 5 to treat with plasma their in-layer and rock spaces with plasma temperature therein reaching tens of thousands degrees Celsius depending on rated current values and the necessary voltage values supported. The voltage rising speed, as well as its maximum value, depends on electric circuit parameters, while presence of super capacitors within this circuit simplifies electric arcs ignition. The more is the distance between neighbor heating wells 5, the more would be maximum value for the voltage able to restore the arc, thus, the distance between wells should be optimal, considering the costs of drilling and expenses to maintain the necessary voltage. With increasing pressure within in-layer and rock spaces, during electric arcs treatment thereof, the plasma temperature rises. At current values up to 10000 A the arc would burn diffused, and that would be the best to treat the in-layer and rock spaces within mountain arrays, while at higher current values it would burn compressed. The electric arc is one of the discharge types in gases or vapors, characterized by high current density, small voltages fall in the arc stem and high temperature. Because any electric circuit has both inductivity and capacity, the inclusion of additional large capacity/impedance, and compact enough to be moved on trucks at surface, super capacitors and inductivity coils into the circuit, results in accumulating substantial electromagnetic energy to be released upon appearance of electric arcs after pre-heating and discharge within mountain rock and layers to be transmitted into the heat, while some portion thereof turns into other types of energy, and the electric arc-emerged, as well as the environment around are both energy sinks. A discharge by artificially created electricity conducting slices, zones and areas within layers and rocks after rising voltages between neighbor heating wells, for the most imaginary comparison and understanding thereof, is close, by nature, to the discharge of lightning in the air resulting from the discharge of the electrical field energy accumulated in atmosphere, with thunder clouds enormous capacity involved.

Within the environment around the arc, evaporated are both liquid and solid components of layers and rocks, within relatively short time periods, under very high temperature. All this results in substantial increase of the in-layer pressure to further increase plasma temperature within the arc burning, thus within layers and mountain rocks arcs burn with very high pressure and temperatures, that move within the in-layer space by artificially created slices with increased electricity conductivity after pumping electroconducting liquid therein, with order and sequence as appropriate, to develop the entire or only some part of the field, resulting in fast change of temperature and stressed-deformed state of layers incorporated into rocks, ore bunches, ledges and lenses, and other mineral resources. Crack and pore systems change to create new cracks and channels, caves and free spaces within layers and incorporating rocks or ores of mountain arrays due to evaporation of solid and liquid phases and other components, that upon extinguishing arcs results in multiple rearrangements of tensions by ground pressure, positively affecting oil and gas inflows into production wells. Oil and bitumen viscosity would be significantly reduced, under high temperature, kerogens would be converted into shale oil, while layer and rocks permeability would improve, resulting in the inflow thereof, to simplify, under significant pressure rise, the extraction from layers. The shale gas, located within shale layers at multiple close caves of different sizes, would also be completely extracted, because the walls between individual caves would be destroyed after high temperature treatment of layers with electric arcs plasma. Treating shale layers with electric arcs would result in virtually complete extraction of shale oils from kerogens, as well as shale gases from these layers, thus being an ecologically friendly method, in comparison to currently used technologies that contaminate and poison territories around fields.

High temperature treatment of oil and gas, coal and shale layers with electric arc plasma may be considered, due to ground pressure drop, an even more efficient method, than underground development of protection layers at coal fields, when a neighbor layer is freed from tension resulting from ground pressure to simplify its degassing, and development after close neighbor protection layer withdrawal, yet it has a number of advantages due to creation of high temperature and pressure that contribute into complete extraction of any oils and gases under most conditions existing.

As a result, after treatment of oil and gas, coal and shale layers of fields with electric arc plasma, the extraction of oils and gases therefrom improves significantly, while shale oils and gas may be extracted completely from fields that are currently mothballed because of suitable extraction methods missing, yet have enormous potential that exceeds several times overall reserves of oil and gas layers Worldwide. The method discussed allows, without ecological issues, redevelopment of long time ago abandoned fields, provided they still have some not extracted oils and gas to approach complete extraction of those resources from fields, both old or long in operation, and new ones, due to heating and treating layers and rocks on fields with electric arcs by electricity conducting slices that are artificially created therein, multiple times with necessary time intervals.

Thus, the method proposed allows the most complete extraction of oil and gas out of oil and gas and shale layers of fields to obtain significant profit, resulting from its usage, and also this method is ecologically friendly. Besides extracting oil and gas out of oil and gas and shale layers the method may be successfully used for underground coal layer gasifying thus significantly increasing extraction of coal, and products derivative thereof, from earth interior, providing for significant decrease of environment contamination with harmful wastes of oil and gas extraction and mining industry (chemical substances, waste rock, extracted underground waters from wells and mine workings with high concentration of sulfur, hydrogen sulfide and other poisonous contaminants that reach rivers and water pools] to improve ecology of territories containing deposits of oil, gas and other mineral resources. In addition, this method allows destroying underground landfills with hazardous wastes of radioactive and chemical industries, via burning and evaporating it underground by means of electric arc plasma. This method also allows melting, into underground workings, from ore bunches, ledges and lenses, of metals, for example, such as iron, copper, nickel, aluminum, silver, gold, as well as rare-earth metals from high viscosity oils and others with high electrical conductivity.

What is claimed is:

1. A method for developing fields and providing for the most complete extraction of high-viscosity and shale oils, bitumens, gas condensates, shale gases and gases from oil, gas and coal layers, according to which at least one operational liquid is pumped under a selected pumping pressure through wells drilled at the fields-into layers, solid electrodes into them, with alternating current applied, electric arcs are initiated either between the solid electrodes of two neighbor wells when oil and gas layers comprise natural electric conductive slices or between pairs of solid electrodes within one well during separation thereof, or during melting of a fuse link between them, move electric arcs within natural electric conductive slices within in-situ space between at least one pair of neighboring wells of fields in necessary order and sequence, wherein, the at least one operational liquid to be pumped under the selected pressure comprises electrically conductive liquid having a viscosity, an electrical conductivity and a density, wherein artificially created slices, zones and areas with raised electrical conductivity are created in individual oil and gas, coal and shale layers after pumping, and, with suit of a plurality of layers, electrical conductivity of those slices is improved, or electrical conductivity of water-bearing slices or water-bearing horizons located adjacent to layers in the suit is raised, and electrically conductive liquid is pumped therein from adjacent heating wells towards each other under pressures that cause penetration to a depth under particular conditions, wherein liquid electrodes comprised of the electrically conductive liquid within the adjacent heating wells are connected to a circuit of alternating-current sources and super capacitors positioned on the surface that accumulate and discharge electromagnetic energy in a form of pulses of alternating current to artificially created conductive slices, zones and areas in layers and rocks, to further increase the voltage of the electrically conductive liquid within heating wells, to carry out heating to achieve discharge within layers, slices or rocks, containing electrically conductive liquid preliminary pumped therein in between interconnected adjacent heating wells, to create electric arcs and to treat a mineral resources field with plasma of the electric arcs, wherein the heating wells at newer fields are lined with electrically-insulating glass-reinforced plastic pipes, and wherein the heating well are optimally positioned within the specified distance from each other depending on power, outstretch and falling of the layers, and depending on different geological and physical and structural properties of rock materials of the layers, their permeability, porosity, and presence of water-bearing slices and horizons; wherein production wells are located within the specified distance in between heating wells; or wherein the existing well network at the fields is optimized by drilling additional heating wells, wherein their walls are not lined with casing pipes within layers, by power, outstretch and falling, and heating wells are repeatedly re-drilled to increase their diameters until a predetermined diameter is reached via specialized hole openers to improve filtration into layers of the electrically conductive liquid and oil or gas during subsequent production from the same wells; wherein, upon completion of a full cycle of layers treatments heating wells are used as production wells; wherein, with the suit of the plurality of layers, spaces in between adjacent layers are repeatedly treated with electric arc plasma from one or more adjacent layers located above or below the spaces, or from water-bearing slices or horizons located within the suit in proximity to layers, water-bearing slices or horizons, or other slices between the layers upon artificially raising its electrical conductivity to alter a stressed-deformed state of other adjacent layers within the suit and to decrease ground pressure thereon due to substantial displacements of mountain rock arrays after treatments to open cracks and pores to form new crack systems and channels for interflow of oils and gases; wherein the density and the viscosity of the electrically conductive liquid is adjusted based on different physical and chemical properties of oils, layer and underground waters, permeability and porosity of layer rocks; wherein electrically conductive liquid is repeatedly pumped at specified time intervals into the artificially created conductive slices, zones and areas within layers or within adjacent water-bearing slices and horizons to maintain and improve their electrical conductivity, to heat up to discharge and to initiate electric arcs therein to maintain the temperatures and pressures specified for the fields by simultaneously creating electric arcs either between particular adjacent heating wells, or between all heating wells at the fields.

2. A method for developing deposits and extracting oil and gas from formations, comprising:

pumping electrically conductive fluid under pressure into a first heating well and a second heating well;

creating an electrically conductive zone between said first heating well and said second heating well via said electrically conductive fluid;

positioning at least one first electrical current source into said first well and at least one second electrical current source into said second well wherein said first and second electrical current sources are in contact with said electrically conductive fluid;

applying alternating current to said at least one first electrical current source and said at least one second electrical current source; and generating an electric arc in said electrically conductive zone via said electrically conductive fluid.

3. The method of claim 2, further comprising the step of electrically insulating walls of said at least one first well and said at least one second well by lining the walls with electrically insulating material.

4. The method of claim 2, wherein the electrically conductive fluid has a viscosity, an electrical conductivity and a density.

5. The method of claim 2, wherein electrically conductive fluid is pumped under pressure into one or more additional heating wells and a plurality of electrically conductive zones are created.

6. The method of claim 5, further comprising the steps of simultaneously creating a plurality of electric arcs in all of the plurality of electrically conductive zones.

7. The method of claim 5, further comprising the steps of creating an electric arc in one or more of the plurality of electrically conductive zones, followed by creating an electric arc in one or more of the remaining electrically conductive zones.

8. The method of claim 2, wherein the alternating current is supplied to said at least one first electrical current source and said at least one second electrical current source in a form of pulses.

9. The method of claim 2, wherein said electrically conductive fluid has density and viscosity selected based at least in part on at least one of physical and chemical properties of oil, formation layers and underground water layers.

10. The method of claim 2, wherein said electrically conductive fluid has density and viscosity selected based at least in part on at least one of permeability and porosity of formation layer materials.

11. The method of claim 2, further comprising the step of heating said electrically conductive zone by increasing voltage of alternating current applied to said at least one first electrical current source and said at least one second electrical current source.

12. The method of claim 2, further comprising the step of pumping additional electrically conductive fluid under pressure into said electrically conductive zone to maintain predetermined electric conductivity of said zone.

13. The method of claim 2, wherein said alternating current is applied by a generator.

14. The method of claim 2, wherein said electrically conductive fluid is pumped into said at least one first heating well in a direction toward said at least one second well, and wherein said electrically conductive fluid is pumped into said at least one second well in a direction toward said at least one first well.

15. The method of claim 2, further comprising the step of reusing said at least one first heating well and said at least one second heating well as production wells upon completion of a full production cycle.

16. The method of claim 2, further comprising the step of drilling said at least one first heating well and said at least one second heating well at a distance from each other, wherein the distance is selected based at least in part on at least one of strength of rock material, permeability of rock material, porosity of rock material, and presence of water-bearing layers.

17. The method of claim 16, further comprising the step of drilling one or more production wells at a predetermined distance from said at least one first heating well and said at least one second heating well.

18. The method of claim 2, wherein a formation has multiple layers and the electric arc is created in two or more adjacent layers to enlarge openings in the layers.

19. The method of claim 2, wherein a formation has multiple layers and the electric arc is created in two or more adjacent layers to cause formation of openings in the layers.

* * * * *